United States Patent [19]

Odenthal

[11] Patent Number: 4,899,790

[45] Date of Patent: Feb. 13, 1990

[54] FILLING APPARATUS FOR A POWDERY PRODUCT

[75] Inventor: Heinz F. Odenthal, Zülpich, Fed. Rep. of Germany

[73] Assignee: Ostma Maschinenbau GmbH, Zulpich, Fed. Rep. of Germany

[21] Appl. No.: 237,758

[22] Filed: Aug. 26, 1988

[30] Foreign Application Priority Data

Sep. 5, 1987 [DE] Fed. Rep. of Germany ..... 8712068

[51] Int. Cl.[4] ..... B65B 43/42

[52] U.S. Cl. ..... 141/134; 141/83; 141/135; 141/74

[58] Field of Search ..... 141/134, 135, 172, 171, 141/137, 83, 168, 270, 275; 198/467.1, 774

[56] References Cited

U.S. PATENT DOCUMENTS

| | | | |
|---|---|---|---|
| 3,045,720 | 7/1962 | Jungmayr et al. | 141/135 |
| 3,152,622 | 10/1964 | Rothermel | 141/134 |
| 3,420,358 | 1/1969 | Iversen | 198/774 |
| 3,621,891 | 11/1971 | Eisenberg | 141/1 |
| 4,061,164 | 12/1977 | Sato et al. | 141/172 |
| 4,290,519 | 9/1981 | Harvey | 198/467.1 |
| 4,301,843 | 11/1981 | Stohlquist | 141/172 |

FOREIGN PATENT DOCUMENTS

| | | | |
|---|---|---|---|
| 163929 | 7/1955 | Australia | 141/134 |
| 216330 | 5/1924 | United Kingdom | 141/172 |

*Primary Examiner*—Ernest G. Cusick
*Assistant Examiner*—Edward C. Donovan
*Attorney, Agent, or Firm*—Herbert Dubno

[57] ABSTRACT

The filling apparatus for a powdery product, especially for a freeze-dried food product, has a container conveyor for a plurality of containers, a measuring device and a plurality of filling funnels which are placed in the containers. The container conveyor has an entrance portion with a feed belt, a filling zone adjoining it and a delivery belt. A plurality of filling funnels is attached to a continuously circulating chain conveyor and guided in the conveying direction on the forwardly moving strand of a chain conveyor above and close to the container conveyor. A conveying screw driven synchronously with the chain conveyor is located in the entrance portion of the conveying belt. Its conveying helix engages the containers laterally so that the containers are movable with a feed speed corresponding to the conveying speed of the chain conveyor and can be spaced as defined in the spacing between the outlets of the filling funnels. A feeder-weigher used as the measuring device is located in the vicinity of the filling zone above the container conveyor. A continuous product flow is fed to the containers moving past with the conveying speed.

6 Claims, 3 Drawing Sheets

1
2
4
5
6
7
8
9
10
11
12
13
14
15
15a
15b
16
17
a
E
F
V
II
III

FILLING APPARATUS FOR A POWDERY PRODUCT

FIELD OF THE INVENTION

My present invention relates to a filling apparatus for a powdery product, especially for a freeze-dried food product.

BACKGROUND OF THE INVENTION

A filling apparatus for filling containers with a powdered food product can have a container conveyor, a measuring or metering device for dispensing a measured amount of product and a plurality of filling funnels which can be placed in a plurality of containers to assist in filling them. The container conveyor has an entrance portion with a feed belt, a filling zone or portion adjoining the entrance portion and a delivery belt following the filling zone.

The filling apparatus currently used in practice is formed with pneumatically lowerable filling funnels and operates cyclically. The filling speed is unsatisfactory in the filling apparatus with these features and indeed also, when—as is common in practice—the containers in a batch are filled simultaneously with product. Also the controller for this apparatus is expensive.

OBJECTS OF THE INVENTION

It is an object of my invention to provide an improved filling apparatus for a powdery product with which continuously moving containers are filled and drawbacks of earlier systems are avoided.

It is another object of my invention to provide an improved filling apparatus filling containers which are moving continuously in a continuous process at a satisfactory filling speed without an excessively expensive controller, with powdered food products.

SUMMARY OF THE INVENTION

According to my invention a plurality of the filling funnels are attached to a continuously circulating chain conveyor and are guided in the conveying direction above the container conveyor close to the container conveyor.

A conveying screw whose helix grips the containers laterally and which is driven synchronously with the chain conveyor is located in the entrance portion of the container conveyor.

The containers are movable with a speed corresponding to the conveying speed of the chain conveyor and can be spaced from each other according to the spacing between the openings of the filling funnels. The path taken by the filling funnels and the container conveyor in the entrance portion are inclined relative to each other as are the path taken by the filling funnels and the container conveyor in the vicinity of the delivery belt. The filling funnels are guidable into and out of the outlets of the containers while the containers are being moved continuously. A feeder-weigher (weighing or metering conveyor) operating the measuring device is located above the container conveyor in the vicinity of the filling zone.

The feeder-weigher contains a guiding and controlling mechanism which controls the product flow according to a predetermined desired value. The feeder-weigher can be connected to a controller which observes the filling rate in the containers and corrects it when there is a deviation from the set value.

Similarly the controller couples the set value for the product flow with the conveying speed of the chain conveyor and in this way synchronizes the speed of the chain conveyor and the product flow.

According to an advantageous feature of my invention the chain conveyor has a substantially horizontal chain guided around a turn to which the filling funnels are attached on one side. In this case the container conveyor in the entrance portion and in the vicinity of the delivery belt are inclined at an entrance angle $\beta$ and a discharge angle $-\beta$ relative to the path taken by the filling funnels (which is substantially horizontal).

An equal spacing between the outlet of the filling funnels is exactly maintained when the filling funnels support themselves against each other.

A shaking unit can be provided to act on the returning strand of the chain conveyor to clean the filling funnels of adhering product residues by vibration.

The container conveyor can be extended in the vicinity of the filling zone as an oscillating extension with an eccentric drive. In this way a satisfactory packing of the product filled into the containers and a high apparent density are attained. In the scope of my invention the oscillating extension also can be formed in two or more parts with individually controllable segments.

In practice the chain conveyor can have a cover with an opening exposing the filling funnels or making them accessible in the vicinity of the filling zone. The product feeding and measuring device above the chain conveyor can provide at least a portion of the cover.

The drive of the filling apparatus can be appropriately a continuously controllable central drive.

Finally the filling apparatus can be connected to a deflector which is operable by another controller which removes the first unfilled container during the operation of the apparatus.

An advantage of my invention is that a high filling speed is attainable since the containers to be filled run continuously through the filling apparatus. Indeed an expensive controller, especially with pneumatic components, is not needed.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
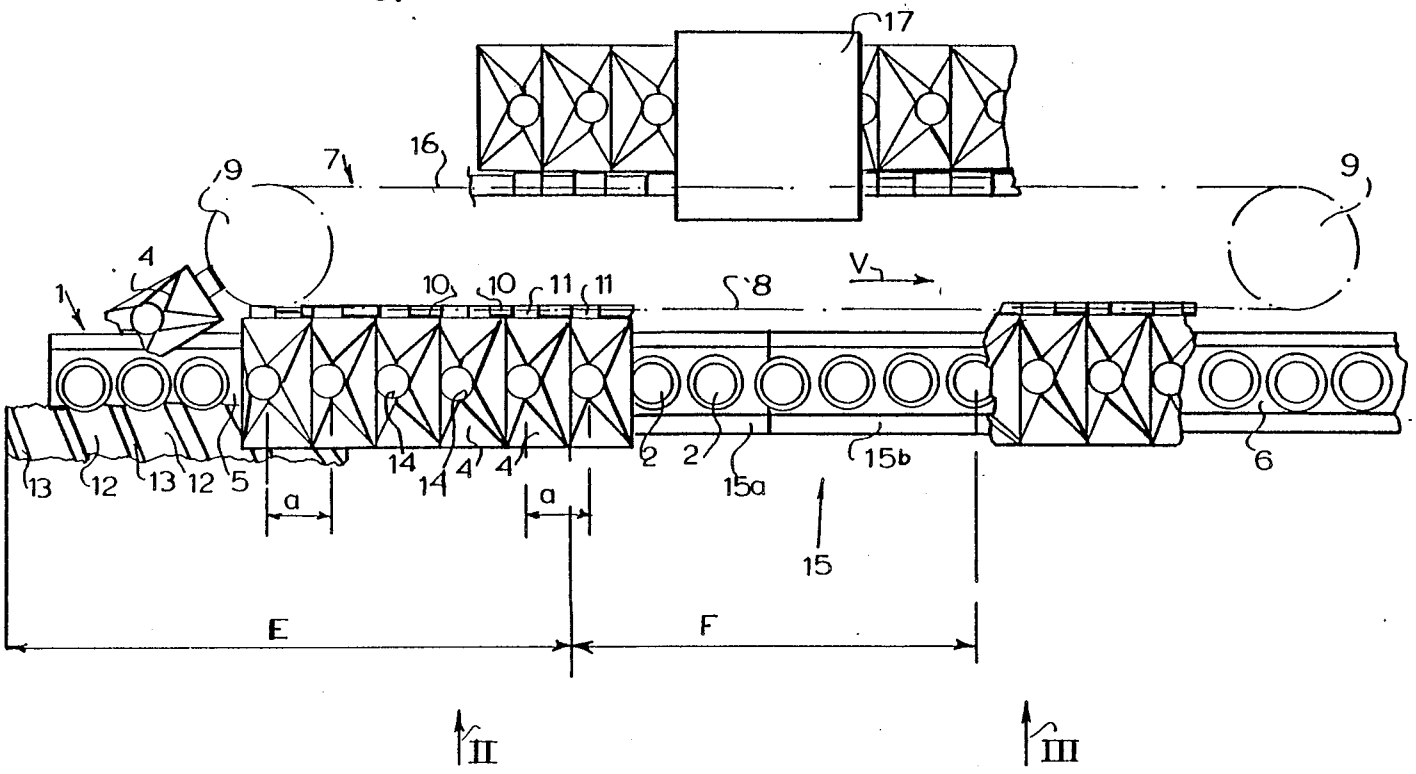
FIG. 1 is a partially cutaway top plan view, partly broken away, of a filling apparatus according to my invention but without illustrations of the metering and/or measuring device for the product.

The filling apparatus shown in the drawing is designed for the packaging of powdery products, especially freeze-dried food. This filling apparatus basically comprises a container conveyor 1 for the containers 2, a measuring and/or metering device 3 and filling funnels 4 which can be placed on the container 2.

The container conveyor 1 has an entrance portion E with a feed belt 5, a filling zone F adjoining it and a delivery belt 6.

The filling funnels 4 are attached to a continuously circulating chain conveyor 7 and are conveyed in the feed direction above the container conveyor 1. These funnels 4 are spaced from but close to the container conveyor 1 and are attached to the forwardly moving strand 8 of the chain conveyor 7.

The chain conveyor 7 is oriented horizontally and has a chain 10 guided around the turn 9 to which the filling funnels are connected with mounting pieces 11 on one side. Thus the filling funnels 4 are supported on one side on the forwardly moving strand 8. The chain conveyor 7 is driven by a drive unit which has not been shown.

Figure 2:
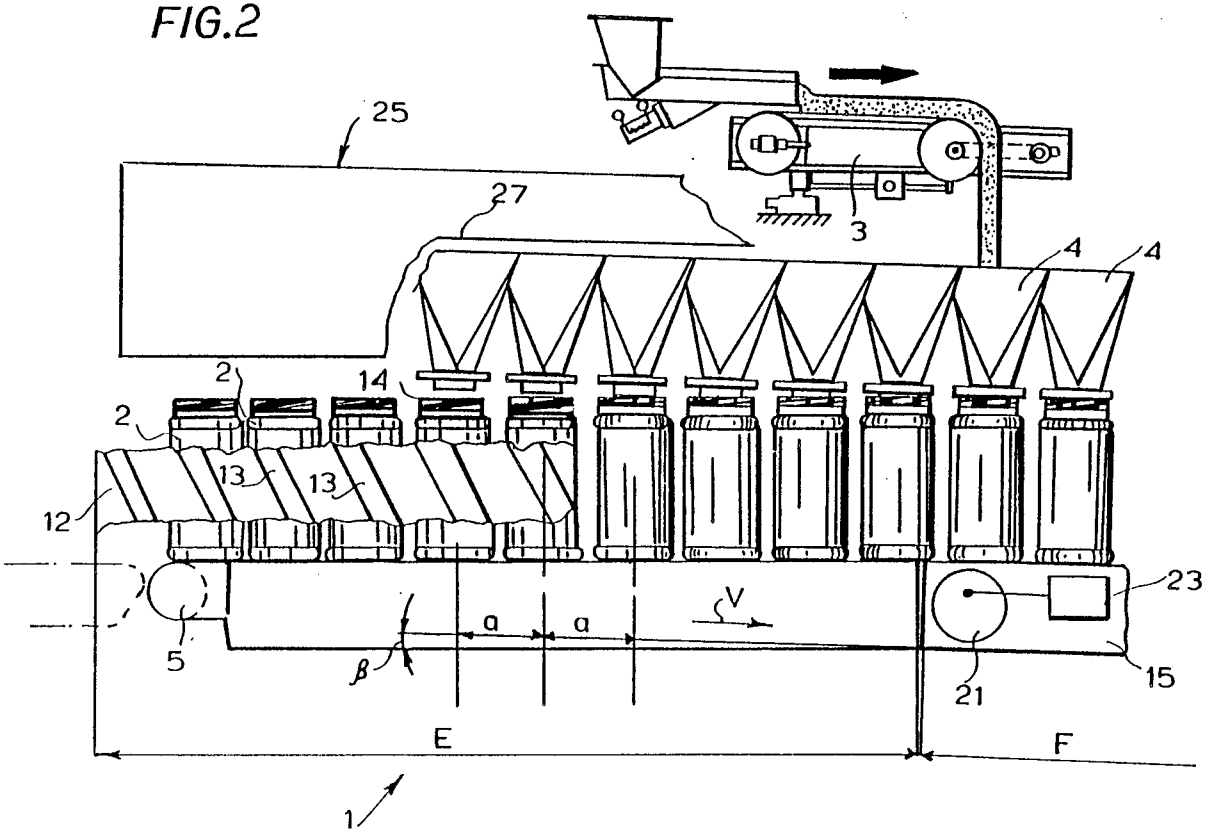
FIG. 2 is a side elevational view of a portion of the filling apparatus taken in the direction indicated by the arrow II in FIG. 1.

From a comparison of FIGS. 1 and 2 it can be seen that a conveying screw 12 driven in synchronization with the chain conveyor 7 is located in the entrance portion E of the container conveyor 1 to bring the containers 2 arriving close to each other into the filling zone F while maintaining the spacing a.

The conveying helix 13 of the conveying screw 12 grips or engages the containers 2 laterally. Hence, the containers 2 are moved along with a continuous feed speed corresponding to the conveying speed v of the chain conveyor 7 and can be spaced from each other according to the spacing a between the outlets 14 of the filling funnel 4.

As is illustrated in FIG. 2 the container conveyor 1 is inclined in the entrance portion E at an angle $\beta$ with respect to the substantially horizontal path of the filling funnels F.

Hence, the filling funnels 4 can be placed in the containers 2 with the outlets 14 during their continuous circulation.

Of course the outlets 14 of the filling funnel 4 are formed for centering the funnels in the jars or like containers to receive the freeze-dried comestible product.

Figure 3:
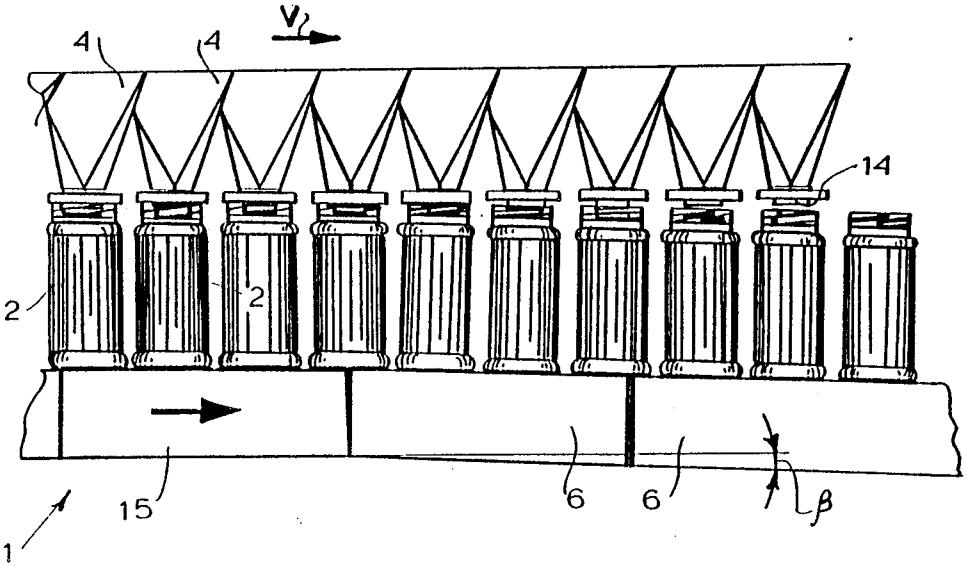
FIG. 3 is a side elevational view of the portion of the filling apparatus indicated by the arrow III FIG. 1.

As can be seen from FIG. 3 the container conveyor 1 also is inclined at a discharge angle $-\beta$ (i.e. in the opposite direction) in the vicinity of the delivery belt 6 and by this lowering of the delivery belt 6 the now filled containers 2 are removed from the centered filling funnels 4 as they move along the continuous path in the transport or conveying direction.

A feeder-weigher 3 is used as a measuring device and is located in the vicinity of the filling zone or region F (FIG. 2). The feeder-weigher 3 provides a continuous product flow to the containers 2 with the funnels 4 mounted in them guided past with the conveying speed v. The feeder-weigher 3 is equipped with controlling and guiding mechanisms in a known way which control the flow of product according to a predetermined set or desired value.

Appropriately the feeder-weigher 3 is connected to a controller which observes the degree of filling in the containers and on deviation from the predetermined set value corrects the actual value for the product flow.

The container conveyor 1 in the filling zone F is usually formed as an oscillating extension 15 driven by an eccentric drive 23 (which can drive a conveyor belt guide wheel 21 which is elliptical for example rather than circular) and indeed may have two individually adjustable extension segments 15*a*, 15*b*. A good packing of the product filled in the containers is attainable by the oscillating extensions 15.

On the return chain strand 16 of the chain conveyor 7 a shaking unit 17—in this embodiment in FIG. 1 covered by a sheet metal housing—is connected to free the filling funnels 4 from the adhering residual product.

A cover 25 can be provided for the chain conveyor 7 which partially covers the filling funnels 4. The measuring or metering device 3 can be part of the cover 25. The cover 25 is provided with an opening 27 for the filling funnels in the vicinity of the filling zone F.

I claim:

1. In a filling apparatus for a powdery product, especially for a freeze-dried food product, comprising a container conveyor for a plurality of containers, a measuring device for said product, and a plurality of filling funnels placable on said containers, said container conveyor having an entrance portion with a feed belt, a filling zone adjoining said entrance portion and a discharge belt, the improvement wherein a plurality of said filling funnels are attached to a continuously circulating chain conveyor and are guided in the conveying direction above said container conveyor close to said container conveyor, a conveying screw driven synchronously with said chain conveyor is located in said entrance portion of said container conveyor whose conveying helix grips said containers laterally to feed said containers continuously, said containers being movable with a speed corresponding to the conveying speed of said chain conveyor and being spaced according to the spacing between the outlets of said filling funnels, the path taken by said filling funnels and said container conveyor in said entrance portion being inclined relative to each other and said path taken by said filling funnels and said container conveyor in the vicinity of said discharge belt also being inclined relative to each other, said filling funnels being guidable into and out of said containers while said containers are being moved continuously, and a feeder-weigher operating as said measuring device is located above said container conveyor in the vicinity of said filling zone.

2. The improvement defined in claim 1 wherein said chain conveyor has a substantially horizontal chain guided around a turn to which said filling funnels are attached on one side and said container conveyor in said entrance portion and in said vicinity of said discharge belt are inclined at an entrance angle B$\beta$ and a discharge angle $-\beta$ respectively relative to said path of said filling funnels.

3. The improvement defined in claim 1 wherein a shaking unit is connected to a returning strand of said chain conveyor, said returning strand being downstream from said delivery belt but upstream from said entrance portion.

4. The improvement defined in claim 1 wherein said container conveyor in said vicinity of said filling zone is constructed as an oscillating extension driven with an eccentric drive.

5. The improvement defined in claim 1 wherein said chain conveyor has a cover with an opening making said filling funnels accessible in said vicinity of said filling zone.

6. A filling apparatus for filling a powdery product, especially for a freeze-dried food product, in a plurality of containers comprising:

a container conveyor for a plurality of containers, said container conveyor having an entrance portion with a feed belt, a filling zone adjoining said entrance portion and a discharge belt following said filling zone, said container conveyor in the vicinity of said entrance portion being inclined at an entrance angle $\beta$ relative to said container conveyor in the vicinity of said filling zone and said container conveyor in the vicinity of said discharge belt being inclined at a discharge angle $-\beta$ relative to said container conveyor in said vicinity of said filling zone, a plurality of filling funnels each having an outlet placable on said containers attached to a continuously circulating chain conveyor and guided in the conveying direction above said container conveyor close to said container conveyor;

a conveying screw driven synchronously with said chain conveyor located in said entrance portion of said container conveyor whose conveying helix grips said containers laterally to feed said containers continuously, said containers being movable with a speed corresponding to the conveying speed of said chain conveyor and being spaced from each other defined in the spacing between said outlets of said filling funnels, said filling funnels being guidable into and out of said containers while said containers are being moved continuously;

a feeder-weigher operating as said measuring device located above said container conveyor in said vicinity of said filling zone; and a shaking unit connected to a returning strand of said chain conveyor, said returning strand being downstream from said delivery belt but upstream from said entrance position.

* * * * *